US006086422A

United States Patent [19]

Glynn

[11] Patent Number: 6,086,422

[45] Date of Patent: Jul. 11, 2000

[54] FILTERED ELECTRICAL CONNECTOR ASSEMBLY HAVING A CONTACT AND FILTERING CIRCUIT SUBASSEMBLY

[75] Inventor: Jerrold Scott Glynn, Northville, Mich.

[73] Assignee: Framatome Connectors Interlock, Inc., Westland, Mich.

[21] Appl. No.: 09/206,459

[22] Filed: Dec. 7, 1998

[51] Int. Cl.[7] ..... H01R 13/66; H01R 33/945

[52] U.S. Cl. ..... 439/620

[58] Field of Search ..... 333/184; 439/620, 439/607, 84

[56] References Cited

U.S. PATENT DOCUMENTS 4,791,391 12/1988 Linnell et al. ..... 339/184
5,286,221 2/1994 Fencl et al. ..... 439/607
5,823,827 10/1998 Belopolsky ..... 439/620

OTHER PUBLICATIONS

Electronic Materials and Processes Handbook Charles A. Harper & Ronald N Sampson, p. 5.57 .
Comprehensive Dictionary of Electrical Engineering Phillip A. LaPlante; CRC Handbook Published; IEEE Press.

*Primary Examiner*—Paula Bradley
*Assistant Examiner*—Phuongchi Nguyen
*Attorney, Agent, or Firm*—Perman & Green, LLP

[57] ABSTRACT

A filter electrical connector having a housing and a contact and filtering circuit subassembly. The contact and filtering circuit subassembly has a ferrite block, electrical contacts passing through the ferrite block, and a lead frame and circuit element assembly. The lead frame and circuit element assembly is mounted on the ferrite block and is electrically connected to the electrical contacts.

17 Claims, 3 Drawing Sheets

FILTERED ELECTRICAL CONNECTOR ASSEMBLY HAVING A CONTACT AND FILTERING CIRCUIT SUBASSEMBLY

BACKGROUND OF THE INVENTION

1. Field of the Invention

The present invention relates to electrical connectors and, more particularly, to a filtered electrical connector.

2. Prior Art

U.S. Pat. No. 5,286,221 discloses a filtered electrical connector assembly having flexible capacitor filter circuits. The flexible circuits have chip capacitors mounted on a flexible circuit substrate. The flexible substrate is mounted to mounting pegs of the housing of the connector and is electrically connected to the contacts. A ferrite block is also connected to the housing. The contacts pass through holes in the ferrite block.

SUMMARY OF THE INVENTION

In accordance with one embodiment of the present invention, an electrical connector circuit subassembly is provided comprising a ferrite block, electrical contacts, and a lead frame and circuit element assembly. The electrical contacts pass through the ferrite block. The lead frame and circuit element assembly is mounted on the ferrite block and is electrically connected to the electrical contacts.

In accordance with another embodiment of the present invention a filtered electrical connector is provided comprising a housing, and a contact and filtering circuit subassembly mounted to the housing. The subassembly comprises a ferrite block, electrical contacts passing through the ferrite block, a lead frame contacting the electrical contacts, and circuit elements mounted on the lead frame. The lead frame is stationarily mounted on the ferrite block such that the subassembly is connected to the housing as a single unit.

In accordance with one method of the present invention a method of manufacturing an electrical connector is provided comprising steps of connecting electrical contact pins to a lead frame; inserting the electrical contact pins into a ferrite block; and wrapping the lead frame onto the ferrite block. The lead frame extends on two opposite sides of the ferrite block to thereby mount the lead frame on the ferrite block.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
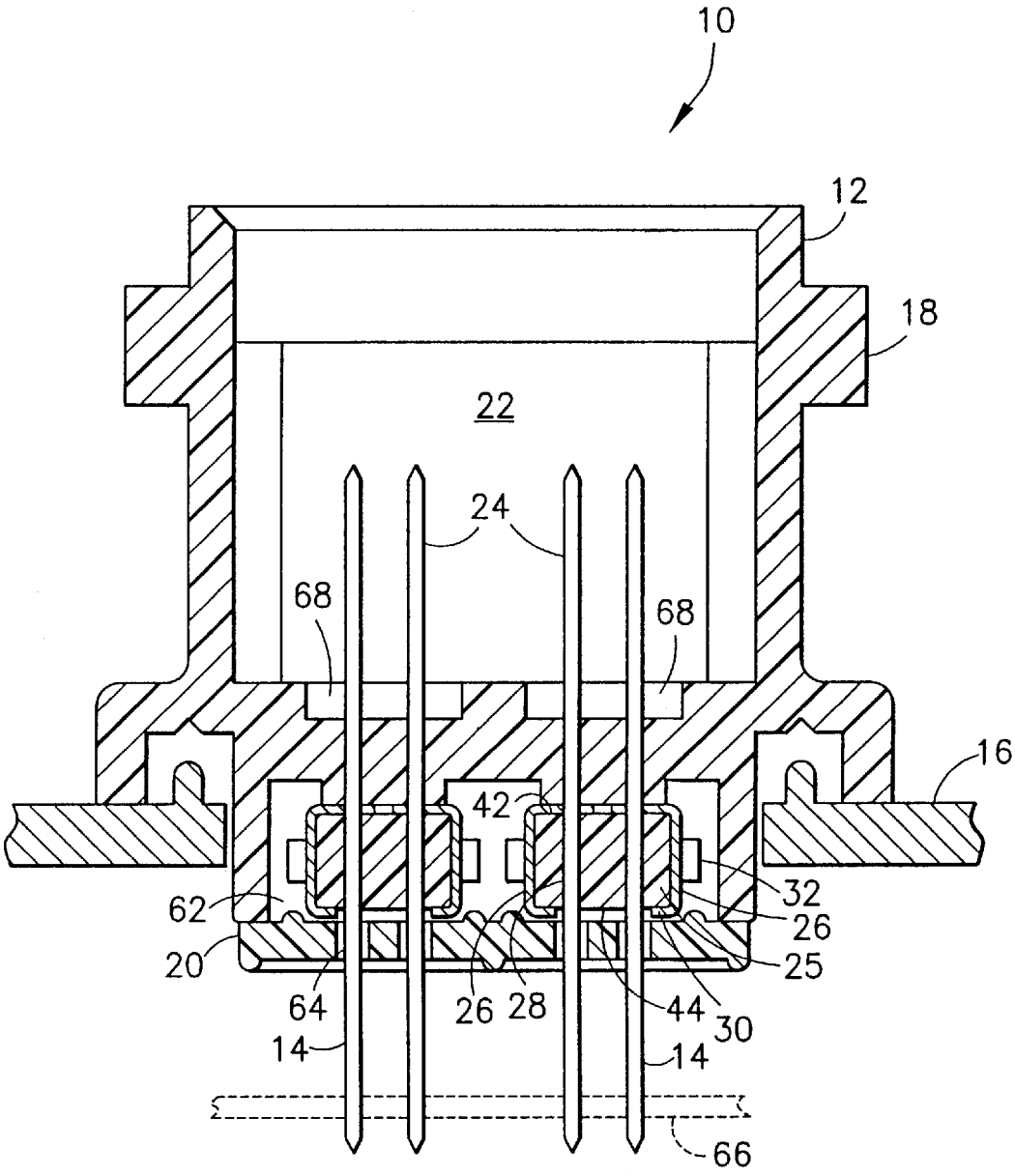
FIG. 1 is a cross-sectional view of a filtered electrical connector incorporating features of the present invention.

Referring to FIG. 1, there is shown a perspective view of a filtered electrical connector 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The connector 10 generally comprises a housing 12 and two electrical contact and filtering circuit subassemblies 14 connected to the housing 12. The housing 12 generally comprises a cast aluminum member 16, a plastic header shroud 18, and a plastic end cap 20. However, in alternate embodiments other types of housings or housing components could be used. The housing 12 has an area 22 for receiving a portion of a mating electrical connector (not shown). The subassemblies 14 are fixedly attached to the housing on the plastic header shroud 18. In alternate embodiments only one subassembly could be provided or more than two subassemblies could be provided.

Figure 2:
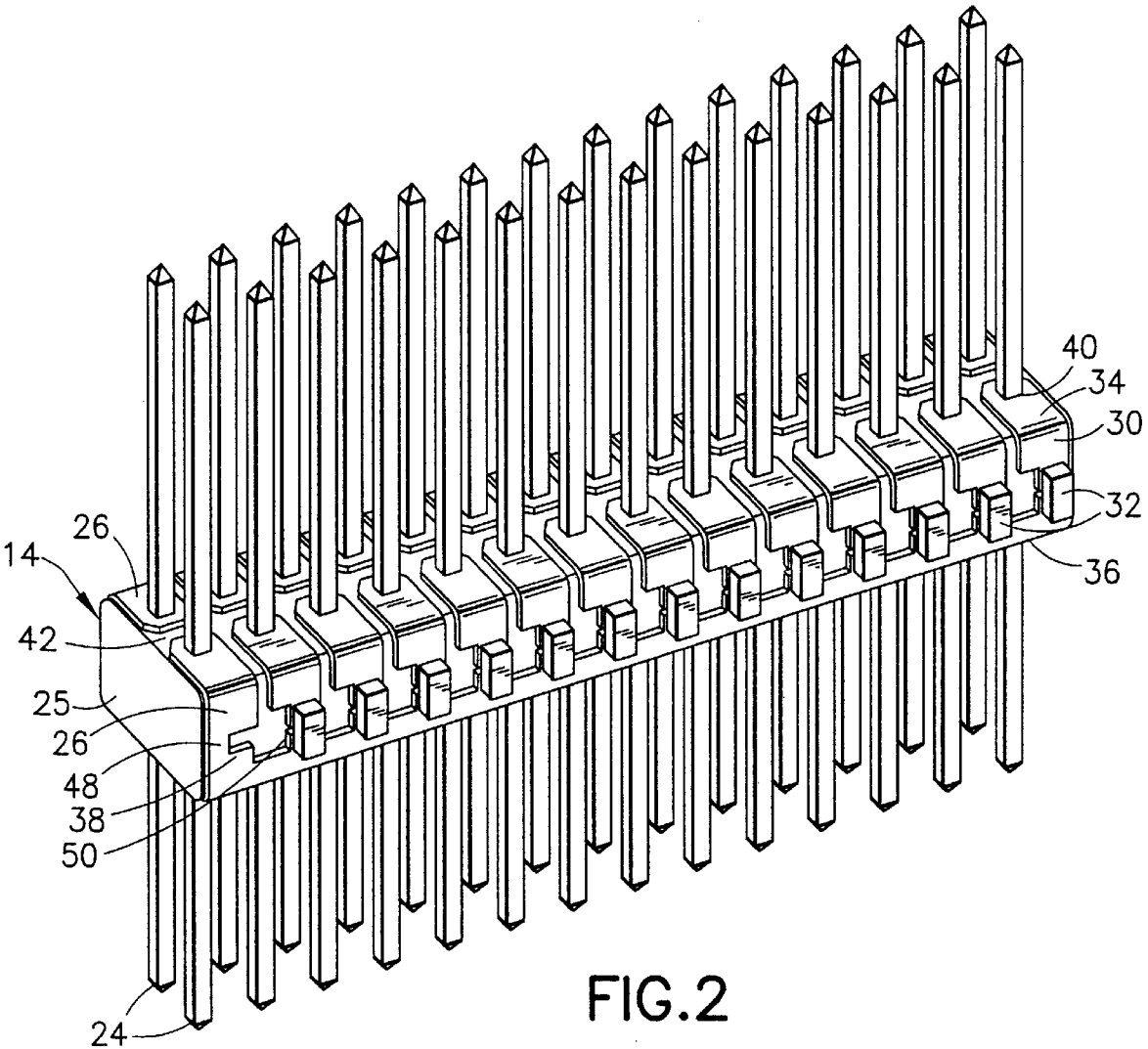
FIG. 2 is a perspective view of a contact and filtering circuit subassembly used in the connector shown in FIG. 1.

In this embodiment the two subassemblies 14 are substantially the same. However, in alternate embodiments the subassemblies could be different. Referring also to FIG. 2, each subassembly 14 generally comprises electrical contacts 24, a ferrite block 25, and two lead frame and circuit element assemblies 26. In an alternate embodiment the subassembly 14 could have only one or more than two of lead frame and circuit element assemblies 26 which are further described below. Each subassembly 14 could also have more than one ferrite block. The ferrite block 25 is merely a block of material comprising ferrite oxide.

The ferrite block has a plurality of holes 28 (see FIG. 1). The contacts 24 pass through the holes 28. Preferably the ferrite block 25 is comprised of an electrically non-conductive ferrite oxide material. However, an electrically conductive ferrite oxide material could also be used if electrical insulators are provided in the holes 28 between the contacts 24 and the ferrite block 25. The ferrite block 25 is provided to function as an attenuator of high frequency signals for EMI and RFI protection. For non-conductive ferrite oxide material, such as having a resistivity of about $10^9$ Ohms/centimeter, this could be for signals between about 50–1000 MHz. For conductive ferrite oxide material, this could be from signals between about 1–150 MHz.

The two lead frame and circuit element assemblies 26 for each subassembly 14 are substantially the same, but they could be different. Each assembly 26 generally comprises a lead frame 30 and circuit elements 32. The lead frames 30 are preferably comprised of sheet metal. The circuit elements 32 are preferably surface mounted on the lead frames 30. Preferably, the circuit elements 32 are chip capacitors. Each lead frame 30 is stationarily mounted onto its respective ferrite block 25. The lead frames 30 have a first end 34, a second end 36, and a middle section 38 therebetween. The first end 34 has holes 40 which the contacts 24 pass through. The lead frames 30 make individual electrical contact with the contacts 24 at the holes 40. In this embodiment each first end 34 has a plurality of separate fingers; one for each contact 24. However, in an alternate embodiment a single first end finger could contact more than one contact. The first end 34 extends on a first side 42 of the ferrite block 25. The second end 36 forms a ground plane for the assembly 26. The second end 36 has tabs 46 (see FIG. 3) which extends on a second side 44 of the ferrite block 25 opposite the first side 42. However, the second end 36 does not directly contact the contacts 24. The middle section 38, in this embodiment, has a bridging section 48 and circuit element mounting areas 50. The bridging section 48 electrically and mechanically connects the first and second ends 34, 36. The bridging section 48 allows the ground plane of the second end 36 to be directly electrically connected to one of the contacts 24; this contact being a ground contact rather than a signal contact. Thus, the lead frame 30 does not need to be electrically connected to the electrically conductive member 16 of the housing 12. The mounting areas 50 each comprise two electrically separate surface mounting tabs 52, 53 (see FIG. 3) directly opposite each other. One tab 52 is attached to the first side 44. The other tab 53 is attached to the second side 46. The circuit elements 32 are surface mount soldered on pairs of the tabs 52, 53 to form electrical circuit paths from the first end 34, through the circuit elements 32, to the second end 36.

Figure 3:
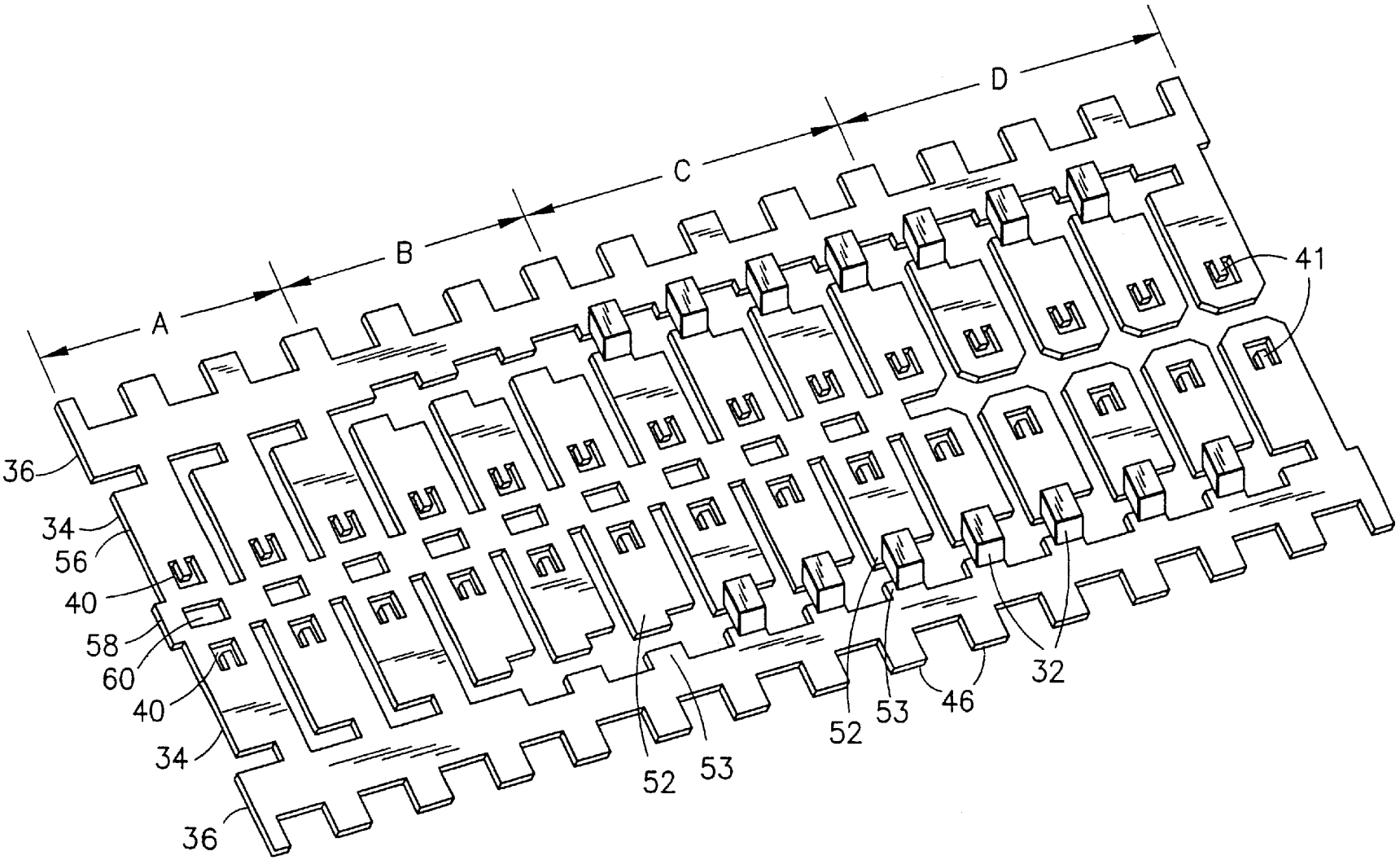
FIG. 3 is a perspective view of a progression forming the lead frame and circuit element assembly used to form the subassembly shown in FIG. 2.

Referring also to FIG. 3, one method of forming the assemblies 26 will be described. The illustration in FIG. 3 is intended to be illustrative only. The various steps may be much more spread out and could occur at different manufacturing locations. The illustrated method shows two of the assemblies 26 being manufactured at the same time, but in alternate embodiments only one or more than two assemblies 16 could be manufactured at the same time with the same steps.

A sheet metal member is stamped by a progressive die forming apparatus to form a blank section 56 (see area A). The progressive die forming apparatus is preferably programmable such that the location and number of the bridging sections 48 and the mounting area 50 can be varied by the manufacturer for different assemblies and connectors. The blank section 56 includes a center with carry strip sections 58 and indexing holes 60, two first ends 56 on opposite sides of the carry strip sections 58, and the second ends 36 with their tabs 46. In this embodiment the holes 40 have interference barbs 41 to make an interference fit with the contact 24. Alternatively, or additionally, the first ends 34 could be soldered to their respective contacts at the holes 40. The blank section 56 is then stamped to form the tabs 52, 53 at area B. The lead frame could be part of a contact carrying bandolier as described in patent application Ser. No. 09/206,143 filed the same day herewith (Attorney Docket No. 611-008317-US(PAR)) which is hereby incorporated by reference. At area C solder paste is applied to the tabs 52, 53, the surface elements 32 are placed on the tabs 52, 53, and heat is applied to reflow solder and thereby electrically and mechanically mount the elements 32 to the lead frame. The carry strip sections 58 are then cut at areas D to form two of the assemblies 26. In an alternate method, the middle section 38 could be cut to form the tabs 52, 53 after the circuit elements 32 are attached to the lead frame. Once the assemblies 26 are formed they are then attached to the contacts 24. Referring back to FIGS. 1 and 2, the contacts 24 and assemblies 26 are then attached to the ferrite blocks 25 In an alternate method the contacts 24 or assemblies 26 could be separately connected to the ferrite blocks 25 before they are connected to each other. Before or during connection of the assemblies 26 to the ferrite blocks 25, the lead frames 30 are bent at the first and second ends 34, 36 such that the assemblies 26 have a general C-shaped profile which each wrap around one lateral side of the ferrite block between the top side 44 and bottom side 44. Since the lead frame 30 is comprised of sheet metal, it is able to retain this shape. Because the contacts 24 pass through the holes 28 in the ferrite block 25, and because the lead frame 30 is attached to the contacts 24 and wrapped onto both opposite sides 42, 44 of the ferrite block 25, a subassembly 14 is formed as a unitary assembly that can be preassembled prior to connection to the housing 12 and, subsequently connected to the housing 12 as a single unit. In this embodiment, as seen in FIG. 1, housing 12 forms a pocket 62 which receives the ferrite blocks 25 and assemblies 26. The end cap 20 encloses the pocket 62 to capture the blocks 25 and assemblies 26 therein. Pocket 62 can be filled with an encapsulant material. The end cap 20 has holes 64 for one end of the contacts 24 to pass through for subsequent connection to a printed circuit board 66. The other ends of the contacts 24 pass through holes in the header shroud 18 and end in the receiving area 22 for the mating electrical connector (not shown). Pocket areas 68 can also be filled with a sealant. Because an electrically non-conductive ferrite block can be used, there is no longer a need for an electrical insulator between the ferrite blocks 25 and the circuitry of the lead frame and circuit element assemblies 26. However, an insulator can be used if one of more of the ferrite blocks are comprised of electrically conductive ferrite oxide material. Because the filtering circuit subassemblies 14 can be manufactured as units separate from the housings 12, and because the holes 28 can be made small due to the fact that the ferrite blocks can be made of electrically non-conductive ferrite oxide, controlling the position of contacts 24 can be improved. There is also no need for a separate retainer for the ferrite block, as in the prior art, because the subassemblies 14 are unitary and can be mounted to the housing as a single unit.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector circuit subassembly comprising:

a ferrite block;

electrical contacts passing through the ferrite block; and a lead frame and circuit element assembly mounted on the ferrite block and electrically connected to the electrical contacts.

2. A circuit subassembly as in claim 1 wherein the lead frame has opposite ends which sandwich a portion of the ferrite block therebetween.

3. A circuit subassembly as in claim 1 wherein the electrical contacts comprise male pins.

4. A circuit subassembly as in claim 1 wherein the ferrite block is comprised of electrically non-conductive ferrite oxide.

5. A circuit subassembly as in claim 4 wherein the ferrite block has a frequency attenuation of greater than 150 MHz.

6. A circuit subassembly as in claim 1 wherein the lead frame has holes which the electrical contacts pass through.

7. A circuit subassembly as in claim 6 wherein the lead frame has interference tabs at the holes which make an interference fit with the contacts.

8. A circuit subassembly as in claim 6 wherein the lead frame is soldered to the contacts.

9. A circuit subassembly as in claim 1 wherein circuit elements of the lead frame and circuit element assembly comprise chip capacitors surface mounted on the lead frame.

10. A circuit subassembly as in claim 2 wherein the lead frame comprises a first section attached to the electrical contacts at a first one of the opposite ends, a second middle section having circuit elements mounted thereon, and a third section forming a ground plane.

11. A circuit subassembly as in claim 10 further comprising tabs extending from the third section which form a second one of the opposite ends.

12. A filter electrical connector comprising:

a housing; and a contact and filtering circuit subassembly mounted to the housing, the subassembly comprising a ferrite block, electrical contacts passing through the ferrite block, a lead frame contacting the electrical contacts, and circuit elements mounted on the lead frame, wherein the lead frame is stationarily mounted on the ferrite block such that the subassembly is connected to the housing as a single unit.

13. A connector as in claim 12 wherein the ferrite block is attached to the housing by the electrical contacts.

14. A connector as in claim 12 wherein the ferrite block is comprised of electrically non-conductive ferrite oxide.

15. A connector as in claim 12 wherein the lead frame has a first end located on a first side of the ferrite block and a second end located on a second opposite side of the ferrite block.

16. A connector as in claim 12 wherein the lead frame comprises a stamped sheet metal member and the circuit elements are surface mounted on the lead frame.

17. A connector as in claim 12 wherein the subassembly comprises two of the lead frames extending along opposite lateral sides of the ferrite block.

* * * * *